US010293246B2

(12) United States Patent
Douglass, II

(10) Patent No.: US 10,293,246 B2
(45) Date of Patent: May 21, 2019

(54) STRUCTURES AND KITS FOR DISPLAYING TWO-DIMENSIONAL IMAGES IN THREE DIMENSIONS

(71) Applicant: Myrl Rae Douglass, II, Honolulu, HI (US)

(72) Inventor: Myrl Rae Douglass, II, Honolulu, HI (US)

( * ) Notice: Subject to any disclaimer, the term of this patent is extended or adjusted under 35 U.S.C. 154(b) by 0 days.

(21) Appl. No.: 15/806,052

(22) Filed: Nov. 7, 2017

(65) Prior Publication Data

US 2018/0056174 A1 Mar. 1, 2018

Related U.S. Application Data

(63) Continuation-in-part of application No. PCT/US2016/031388, filed on May 7, 2016.

(60) Provisional application No. 62/159,065, filed on May 8, 2015.

(51) Int. Cl.

| | |
|---|---|
| ***A63F 9/06*** | (2006.01) |
| ***A63H 33/08*** | (2006.01) |
| ***A63F 9/12*** | (2006.01) |

(52) U.S. Cl.

CPC ..... *A63F 9/0613* (2013.01); *A63F 9/1208* (2013.01); *A63H 33/08* (2013.01); *A63F 2009/128* (2013.01); *A63F 2009/1232* (2013.01); *A63F 2009/1236* (2013.01); *A63F 2250/50* (2013.01)

(58) Field of Classification Search

CPC ..... A63B 9/0613; A63F 9/1208; A63F 2009/1236; A63F 2250/50; A63F 2009/0615; A63F 2009/0616; A63F 2009/062

See application file for complete search history.

(56) References Cited

U.S. PATENT DOCUMENTS

| | | | | | |
|---|---|---|---|---|---|
| 1,709,660 | A * | 4/1929 | De Bracht | A63F 9/1204 | 273/157 R |
| 1,964,007 | A * | 6/1934 | Parks | A63F 9/12 | 273/157 R |
| 2,731,766 | A * | 1/1956 | Rubin | A63F 9/12 | 273/157 R |
| 3,100,642 | A * | 8/1963 | Goldstein | A63F 3/00895 | 206/459.5 |
| 3,662,486 | A * | 5/1972 | Freedman | A63F 9/088 | 220/DIG. 13 |
| 4,308,016 | A * | 12/1981 | White | G09B 19/00 | 273/157 R |

(Continued)

OTHER PUBLICATIONS

International Search Report for International Application No. PCT/US 16/31388, dated Aug. 30, 2016.

*Primary Examiner* — Steven B Wong

(74) *Attorney, Agent, or Firm* — Steven R. Vosen

(57) ABSTRACT

A three dimensional structures, which may be formed as a three-dimensional jigsaw puzzle, are described. The structure has one or more viewing directions along which different images are viewable. An image to be presented is divided into image portions that are applied to primary surfaces, where the structure has the primary surfaces arranged to present the image when viewed along an axis. The structure may also have secondary surfaces that are hidden from view along a viewing direction, and which become viewable when the structure is rotated relative the viewer. The structure may also be in a puzzle, which may be in the form of a kit.

16 Claims, 21 Drawing Sheets

(56) References Cited

U.S. PATENT DOCUMENTS

| | | | | |
|---|---|---|---|---|
| 4,666,163 | A * | 5/1987 | Hirschfeld | A63F 1/02 273/157 R |
| 5,525,060 | A * | 6/1996 | Loebner | G09B 19/08 434/157 |
| 5,642,884 | A | 7/1997 | Pitcher | |
| 5,785,319 | A * | 7/1998 | Frauhiger | A63F 9/1204 273/157 R |
| 5,791,647 | A * | 8/1998 | Reiling | A63F 9/1288 273/157 R |
| 6,237,914 | B1 * | 5/2001 | Saltanov | A63F 9/12 273/156 |
| 6,439,945 | B1 * | 8/2002 | Liu | A63H 3/16 273/156 |
| 7,469,898 | B2 * | 12/2008 | Forakis | A63F 9/1252 273/156 |
| 2005/0219695 | A1 | 10/2005 | Vesely et al. | |
| 2007/0007724 | A1 | 1/2007 | Kessler | |
| 2009/0127785 | A1 | 5/2009 | Kishon | |
| 2011/0042893 | A1 | 2/2011 | Someya | |

* cited by examiner

| | | |
|---|---|---|
| 1121a | 1112a | 1123a |
| 1114a | 1125a | 1116a |
| 1127a | 1118a | 1129a |

FIG. 4A

| | | |
|---|---|---|
| 1211a | 1222a | 1213a |
| 1224a | 1215a | 1226a |
| 1217a | 1228a | 1219a |

FIG. 4B

| | | |
|---|---|---|
| 1123b | 1132b | 1121b |
| 1136b | 1125b | 1134b |
| 1129b | 1138b | 1127b |

FIG. 4C

| | | |
|---|---|---|
| 1233b | 1222b | 1231b |
| 1226b | 1235b | 1224b |
| 1239b | 1228b | 1237b |

FIG. 4D

STRUCTURES AND KITS FOR DISPLAYING TWO-DIMENSIONAL IMAGES IN THREE DIMENSIONS

CROSS-REFERENCE TO RELATED APPLICATIONS

This application is a continuation-in-part of PCT Patent Application No. PCT/US2016/031388, filed May 7, 2016, which claims the benefit of U.S. Provisional Application 62/159,065, filed May 8, 2015. The contents of these applications are hereby incorporated by reference in their entirety.

BACKGROUND OF THE INVENTION

Field of the Invention

The present invention generally relates to displaying images on a three-dimensional structure, and more particularly to an apparatus or kit for combining one or more two-dimensional images for viewing on a three-dimensional structure.

Discussion of the Background

There are several ways of combining two-dimensional images on a three-dimensional structure. Thus, for example, architectural scale models of typically include a three-dimensional body with markings on the body surfaces. It is clearly the intent that the scale model, including the body and markings, faithfully represent an actual or proposed structure. It is also known that scale models may be approximated from a plurality of puzzle pieces that may be assembled to form the scale model.

In general, the forming of such models or puzzles requires the assembly of a plurality of different views of the original, or proposed, object. Further, producing a puzzle of a model may include compromises due to limitations of how such pieces may be assembled.

While the benefits of forming scale models, including puzzles of the models, are well understood, there are limitations in such a model. There exists a need for a simpler and more adaptable method and a structure for presenting two-dimensional images in three dimensions. Such a method and structure may be made using only one or a few views, and may provide a viewing experience that is not as exact as a scale model, but which combines the views in artistic ways.

BRIEF SUMMARY OF THE INVENTION

The present invention overcomes the disadvantages of prior art by providing a structure having staggered pieces, each with a portion of an image that is viewable along a viewing direction.

It is one aspect to provide a three-dimensional structure comprising a plurality of surfaces for presenting an image when the three-dimensional structure is viewed along a viewing direction. The plurality of surfaces includes one or more primary surfaces each including a portion of the image, where the portion of the image on each of the one or more primary surfaces is visible when the three-dimensional structure is viewed along the viewing direction; and one or more secondary surfaces each disposed behind an opaque portion of the one or more primary surfaces when the three-dimensional structure is viewed along the viewing direction, where each of the one or more secondary surfaces includes a portion of the image. The image is viewable on the one or more primary surfaces when the three-dimensional structure is viewed along the viewing direction, and portions of the image on the one or more secondary surfaces are visible when the three-dimensional structure is viewed off-axis from the viewing direction.

It is yet another aspect to provide a three-dimensional structure having from 1 to 6 viewing directions.

It is another aspect to provide three-dimensional puzzle comprising a plurality of first pieces and a plurality of second pieces. The plurality of first pieces each have a corresponding surface of a plurality of first surfaces, where, when the three-dimensional puzzle is assembled, the plurality of first surfaces are adapted for viewing a first image along a first viewing direction of the assembled three-dimensional puzzle. The plurality of first surfaces includes one or more primary surfaces each including a portion of the first image, where, when the three-dimensional puzzle is assembled, the portion of the first image on each of the one or more primary surfaces is visible when the three-dimensional structure is viewed along the first viewing direction, and also include one or more secondary surfaces each disposed behind an opaque portion of the one or more primary surfaces when the three-dimensional puzzle assembled and viewed along the first viewing direction, where each of the one or more secondary surfaces includes a portion of the first image. The plurality of second pieces each has a corresponding surface of a plurality of second surfaces. The plurality of second surfaces includes a plurality of second pieces each having a corresponding surface of a plurality of second surfaces, where, when the three-dimensional puzzle is assembled, the plurality of second surfaces are adapted for viewing a second image along a second viewing direction of the assembled three-dimensional puzzle, where the plurality of second surfaces includes one or more primary surfaces each including a portion of the second image, where, when the three-dimensional puzzle is assembled, the portion of the second image on each of the one or more primary surfaces is visible when the three-dimensional structure is viewed along the second viewing direction, and one or more secondary surfaces each disposed behind an opaque portion of the one or more primary surfaces when the three-dimensional puzzle assembled and viewed along the second viewing direction, where each of the one or more secondary surfaces includes a portion of the second image. The portions of the first image on the one or more secondary surfaces are visible when the three-dimensional puzzle is viewed off-axis from the first viewing direction, and the portions of the second image on the one or more secondary surfaces are visible when the three-dimensional puzzle is viewed off axis from the second viewing direction.

It is another aspect of to provide a kit including a plurality of pieces of the three-dimensional puzzle.

These features together with the various ancillary provisions and features which will become apparent to those skilled in the art from the following detailed description, are attained by the structures and kits of the present invention, preferred embodiments thereof being shown with reference to the accompanying drawings, by way of example only, wherein:

BRIEF DESCRIPTION OF THE SEVERAL VIEWS OF THE DRAWING

FIG. 4A is the view of structure along first viewing direction, which shows the primary surfaces;

FIG. 4B is the view of structure along second viewing direction, which shows the primary surfaces;

FIG. 4C is the view of structure along third viewing direction, which shows the primary surfaces;

FIG. 4D is the view of structure along fourth viewing direction, which shows primary surfaces;

FIG. 10A is a top view of the structure, FIG. 10B is a view of a first image as the structure is viewed along a first viewing direction, FIG. 10C is a view of the stricture along a direction halfway between the first viewing direction and a second viewing direction, FIG. 10D is a view of a second image as the structure is viewed along the second viewing direction, FIG. 10E is a view of the structure along a direction halfway between the second viewing direction and a third viewing direction, FIG. 10F is a view of the third image as the stricture is viewed along the third viewing direction, FIG. 10G is a view of the stricture along a direction halfway between the third viewing direction and a fourth viewing direction, FIG. 10H is a view of a fourth image as the structure is viewed along the fourth viewing direction, and FIG. 10I is a view of the stricture along a direction halfway between the fourth viewing direction and the first viewing direction;

Reference symbols are used in the Figures to indicate certain components, aspects or features shown therein, with reference symbols common to more than one Figure indicating like components, aspects or features shown therein.

DETAILED DESCRIPTION OF THE INVENTION

The present invention includes structures for presenting two-dimensional images on three dimensional structures. The two-dimensional images can include, for example and without limitation, solid fields of a single color or material finish, abstract compositions of multiple colors and finishes, or realistic representations of various subjects. The structures may be formed from pieces joined together, either by using adhesives, joining elements, or as puzzle pieces which fit into one another, arranged so that different pieces are viewable at different angles relative to the structure. The pieces may also be provided with portions of one or more images such that when the structure is viewed along certain axis, images will appear to an observer.

In general, certain embodiments of the present invention include providing portions of two-dimensional imagery ("images") into the surfaces of a three-dimensional structure or puzzle pieces, so that a sculptural form emerges from the assemblage. The three-dimensional structure or puzzle includes a variety of surfaces distribute in space and does not includes a model of the actual solid form representing exterior surfaces of objects, as in more traditional methods. Instead the sculpture is perceived through the mind's ability to connect and combine the images when they are presented on surfaces in a rational manner in three-dimensional space.

The structures described herein include a plurality of generally flat elements, having surfaces with portions of an image. The elements are arranged such that they are directed towards a viewing direction, and may include portions of an image, such that when the structure is viewed along the viewing direction, the image is visible. The structure may have between 1 and 6, or more, viewing directions, and the elements visible in each viewing direction are arranged in 2 or more planes.

In certain embodiments, a coordinate system is established for the structure on which images are provided. The coordinate system may be, but is not limited to, an orthogonal system consisting of an X and Y axis, or of an X, Y, and Z axis, each of which is orthogonal to the other axis. While the invention is generally described in terms of such a coordinate system, other systems may be used based on other geodetic parameters, and are within the scope of the present invention. For the purposes of this application, descriptions are for orthogonal systems.

Figure 1A:
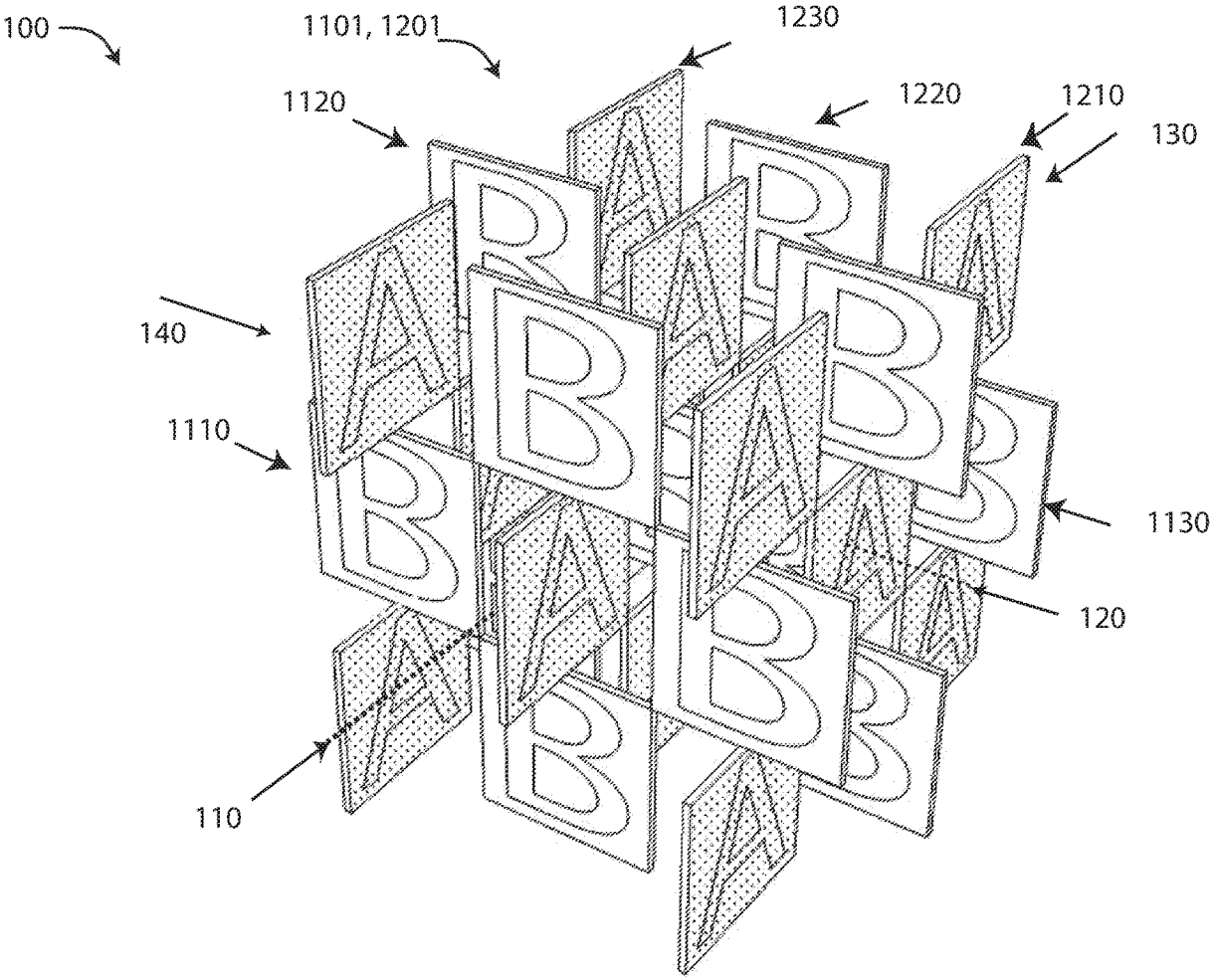
FIG. 1A is a perspective view of a structure having four viewing directions, and that includes a plurality of elements, labeled "A," arranged in planes, and which present surfaces towards a first viewing direction, and a plurality of elements, labeled "B," arranged in planes, and which present surfaces towards a second viewing direction.

FIG. 1A is a perspective view of a structure 100 having four viewing directions 110/120/130/140. The view of FIG. 1A highlights two viewing directions: a plurality of elements 1101, labeled "A," arranged in planes 1110, 1120, and 1130, and which present surfaces towards a first viewing direction 110, and a plurality of elements 1201, labeled "B," arranged in planes 1210, 1220, and 1230, and which present surfaces towards a second viewing direction 120. As discussed subsequently, elements 1101 and 1201 which are staggered within each plane such that when a viewer looks at structure 100 along a viewing direction 110 or 120 that will be seen are elements on at least two different planes at the same time.

The embodiment of FIG. 1A is for illustrative purposes, and is not meant to limit the scope of the present invention. Thus, for example, the elements may be arranged on 2 planes, or on 4 or more planes; the pieces may be flat, but arranged to a viewing direction at some angle. Thus, for example, the angle between the normal to each element 1101 and the viewing direction, which is 0 degrees in FIG. 1A, may be up to 45 degrees. In other embodiments, the surfaces may be curved.

The structures, including puzzles, described herein may be made of any material that can support the weight of the structure and may be, for example and without limitation, be a sheet of plastic sheet, wood, plywood, cardboard, or a form of clear plastic such as Plexiglas, or a metal.

As is shown in FIG. 1A, structure 100 is an open structure formed from a staggered assembly of elements. In one embodiment, the edges of each piece touch and are supported by the edge of at least one other piece. Thus, for example, each piece of the plurality of elements 1101 is touching and is supported on an edge of one or more pieces of the plurality of elements 1201, and each piece of the plurality of elements 1101 is touching and is supported on an edge of one or more pieces of the plurality of elements 1201.

Figure 1B:
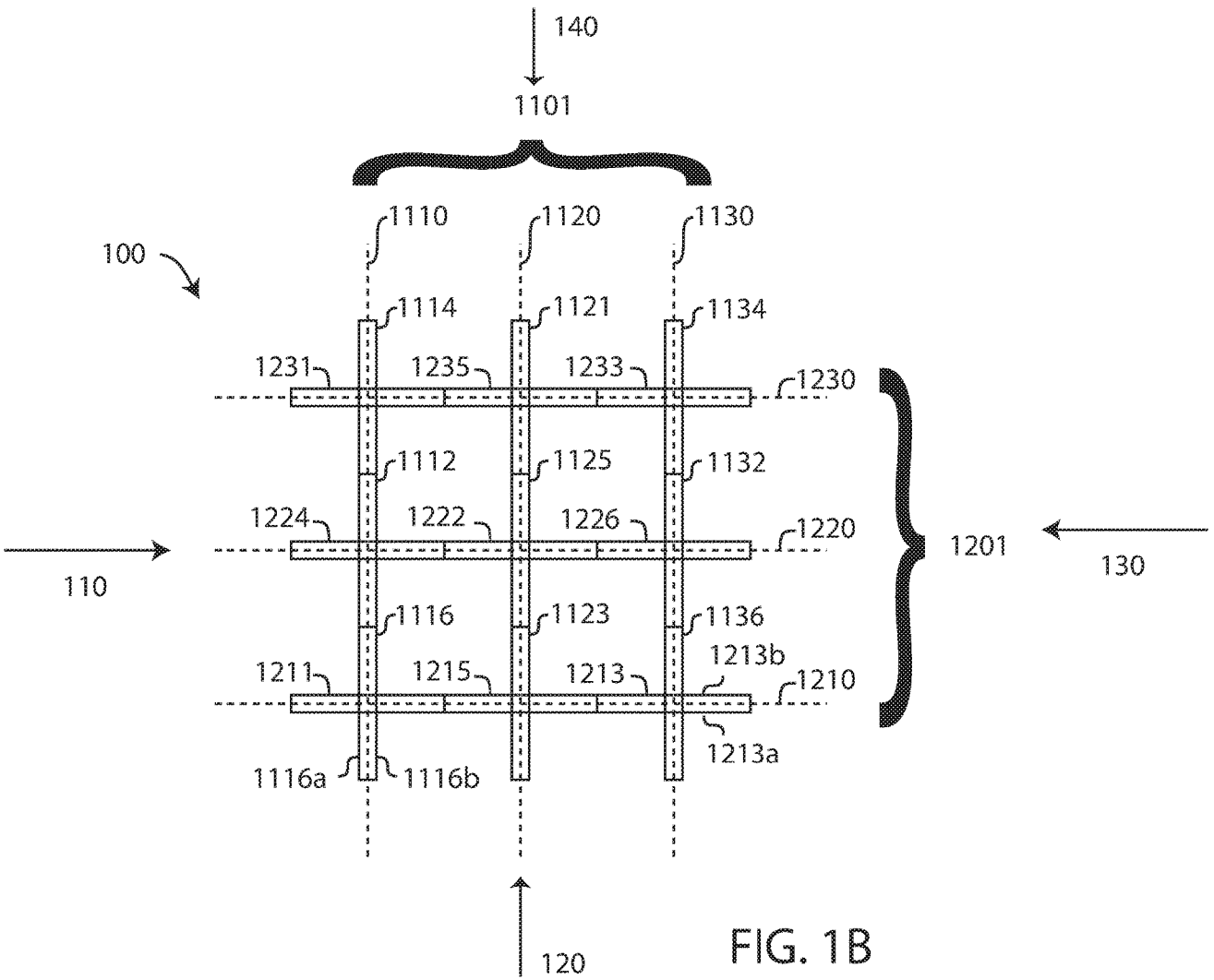
FIG. 1B is a top view of structure of FIG. 1A.

FIG. 1B is a top view of structure 100 of FIG. 1A, and FIGS. 2A, 2B, and 2C are views along viewing direction 110 showing surfaces of elements 1101 that are in planes 1110, 1120, and 1130, respectively (labeled "A" in FIG. 1A). When structure 100 is viewed along one of the viewing directions, certain surfaces, referred to herein without limitation as "primary surfaces," are visible to the viewer, certain other surfaces, referred to herein without limitation as "secondary surfaces," are behind opaque portions of primary surfaces and thus are not visible to the viewer if the elements and surfaces, and other surfaces are at 90 degrees to the viewing direction, and thus are not visible. Thus, for example, along viewing direction 110, elements in planes 1110 and 1120 are present primary surfaces to the viewer, while elements in plane 1130 are secondary surfaces which are behind a primary surface, and elements in all other planes are at 90 degrees to the viewer and the surfaces of those elements are not visible.

Figure 2B:
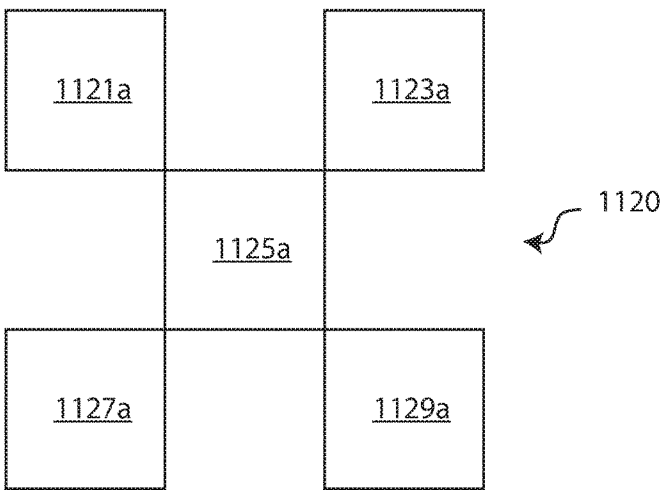
FIGS. 2A, 2B, and 2C are side views of the elements of FIG. 1A along the first viewing direction showing surfaces of elements that are labeled "A;"
Figure 2A:
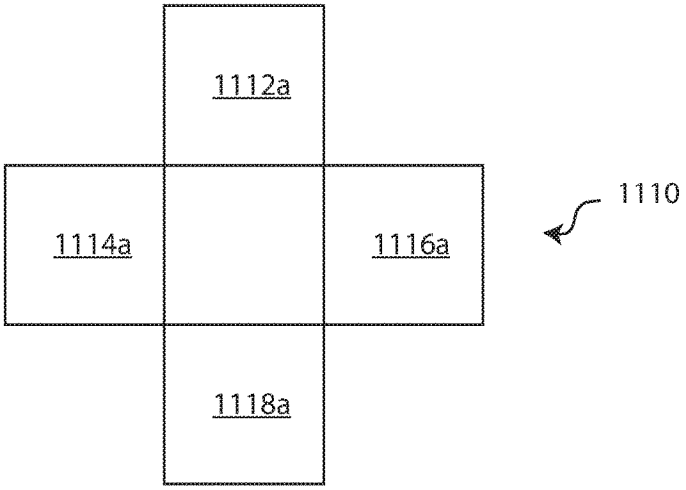
Figure 2C:
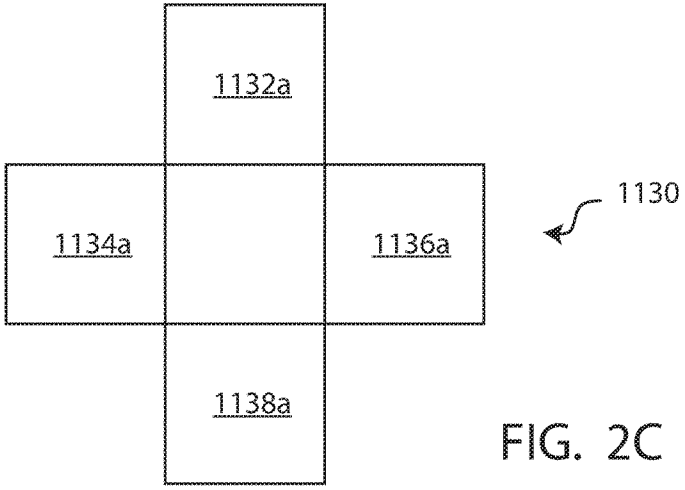

As shown in FIGS. 1A, 2A, 2B, and 2C, each element of the plurality of elements 1101 has a first surface (with a suffix "a") faces first viewing direction 110. Thus, for example: FIGS. 1B and 2A show that elements of plane 1110 present, to viewing direction 110, primary surfaces 1112*a*, 1114*a*, 1116*a*, and 1118*a* of elements 1112, 1114, 1116, and 1118, respectively; FIGS. 1B and 2B show that elements of plane 1120 present, to viewing direction 110, primary surfaces 1121*a*, 1123*a*, 1125*a*, 1127*a*, and 1129*a* of elements 1121, 1123, 1125, 1127, and 1129, respectively; and FIGS. 1B and 2B show that the elements of plane 1130 present, in viewing direction 110, secondary surfaces 1132*a*, 1134*a*, 1136*a*, and 1138*a* of elements 1132, 1134, 1136, and 1138, respectively.

When structure 100 is viewed from a viewing direction, adjacent surfaces alternate between different planes, and some of the surfaces may not be visible since other surfaces may be between the surface and the viewer. FIG. 4A is the view of structure 100 along first viewing direction 110, which shows the following surfaces are in view: primary surfaces 1112*a*, 1114*a*, 1116*a*, and 1118*a* in plane 1110 and primary surfaces 1121*a*, 1123*a*, 1125*a*, and 1127*a* of plane 1120. Secondary surfaces 1132*a*, 1134*a*, 1136*a*, and 1138*a* in plane 1130 are behind primary elements 1112, 1114, 1116, and 1118, respectively, and are thus not visible if primary elements 1112, 1114, 1116, and 1118 are not transparent. The surfaces in view alternate between planes 1110 and 1120 as structure 100 is scanned across or down in viewing direction 110. Thus, from any element in view, the adjacent element is from a different plane.

Since the elements in adjacent planes are staggered, if structure 100 is viewed slightly off-axis from a viewing direction, portions of the secondary surfaces will not be blocked by a primary surface, and thus will become visible. Thus, for example, if structure 100 is viewed several degrees away from viewing direction 110, a portion of secondary surfaces 1132*a*, 1134*a*, 1136*a*, and 1138*a* will be visible to the viewer. The uncovering of surfaces as structure 100 is rotated can provide for visual effects, as described subsequently.

Figure 3B:
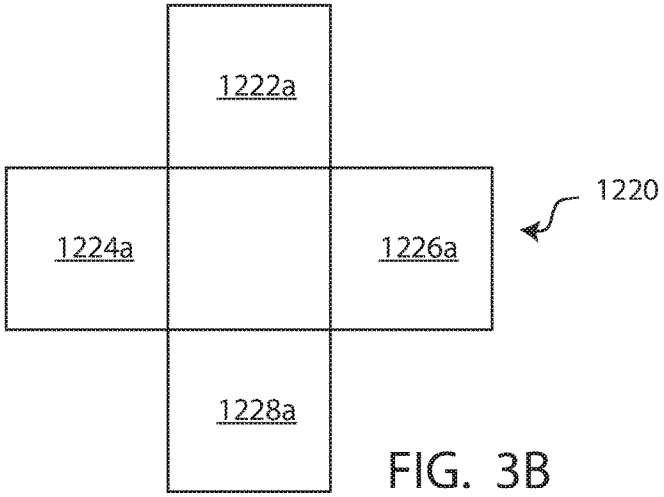
FIGS. 3A, 3B, and 3C are side views of the elements of FIG. 1A along the second viewing direction, showing surfaces of elements that are labeled "B;"
Figure 3C:
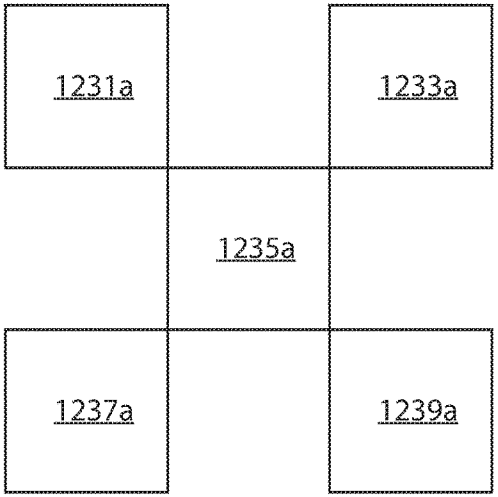
Figure 3A:
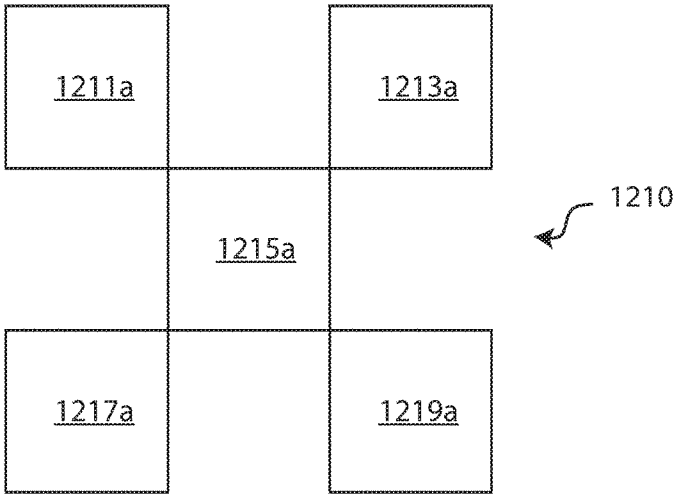
Figure 5A:
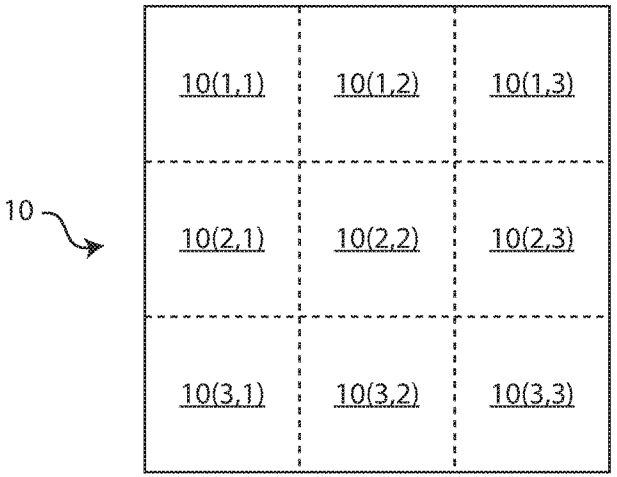
FIGS. 5A, 5B, 5C, and 5D show several images.
Figure 5B:
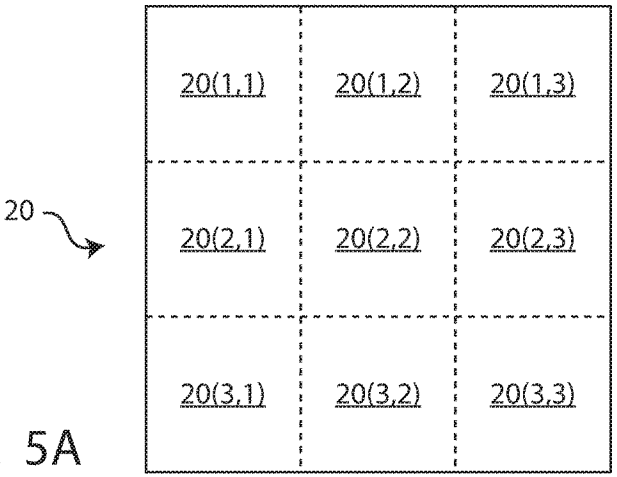
Figure 5C:
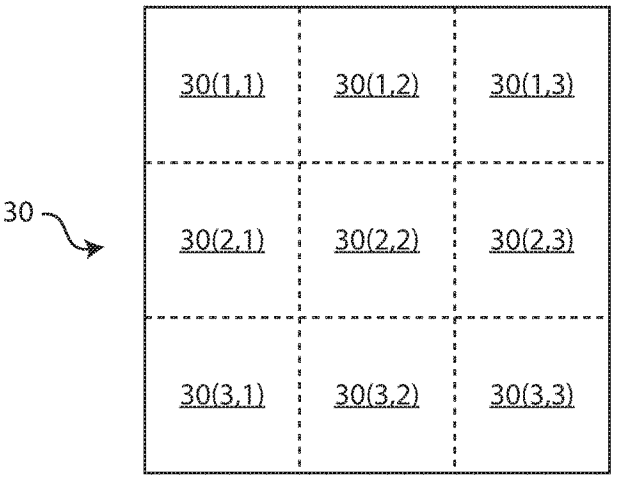
Figure 5D:
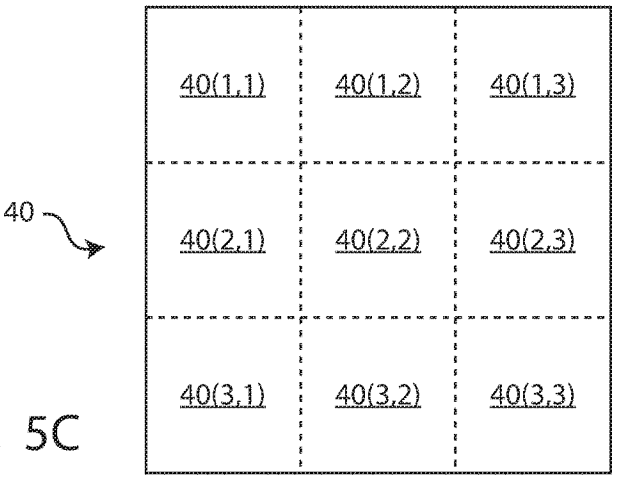

Elements 1201 have a similar arrangement. FIGS. 3A, 3B, and 3C are side views along viewing direction 120, showing surfaces of elements 1201 that are in planes 1210, 1220, and 1230, respectively (labeled "B" in FIG. 1A). Thus, for example: FIGS. 1B and 3A show that the elements of plane 1210 present, to viewing direction 120, primary surfaces 1211*a*, 1213*a*, 1215*a*, 1217*a*, and 1219*a* of elements 1211, 1213, 1215, 1217, and 1219, respectively. FIGS. 1B and 3B show that elements of plane 1220 present, to viewing direction 120, primary surfaces 1222*a*, 1224*a*, 1226*a*, and 1228*a* of elements 1222, 1224, 1226, and 1228, respectively; and FIGS. 1B and 3B show that plane 1230 present, to viewing direction 120, secondary surfaces 1234*a*, 1233*a*, 1235*a*, 1237*a*, and 1239*a* of elements 1234, 1233, 1235, 1237, and 1239, respectively, which are behind primary surfaces of elements in plane 1210.

FIG. 4B is the view of structure 100 along second viewing direction 120, which shows that, along this viewing direction, the following surfaces are in view: primary surfaces 1211*a*, 1213*a*, 1215*a*, 1217*a* and 1219*a* of plane 1220 and primary surfaces 1222*a*, 1224*a*, 1226*a*, and 1228*a* of plane 1220. Secondary surfaces 1234*a*, 1233*a*, 1235*a*, 1237*a*, and 1239*a* in plane 1230 are behind primary elements 1214, 1213, 1215, 1217, and 1219, respectively, and are thus not visible if primary elements 1214, 1213, 1215, 1217, and 1219 are not transparent. The elements in view alternate between planes 1120 and 1220 as structure 100 is scanned across or down in viewing direction 120. Thus, from any element in view, the adjacent element is from a different plane.

As discussed above regarding viewing direction 110, if structure 100 is viewed slightly off axis from of viewing direction 120, portions of the secondary surfaces will not be blocked by a primary surface, and thus will become visible. Thus, for example, if structure 100 is viewed several degrees away from viewing direction 110, a portion of secondary surfaces 1132*a*, 1134*a*, 1136*a*, and 1138*a* will be visible to the viewer. The uncovering of surfaces as structure 100 is rotated can provide for visual effects, as described subsequently.

It is seen that structure 100 may have two additional viewing directions with similar features. Specifically, FIGS. 1A and 1B show a third viewing direction 130 which is an opposite view of first viewing direction 110, and a fourth viewing direction 140 which is an opposite view of second viewing direction 120. As noted above, the "a" surfaces of elements 1101 are presented towards first viewing direction 110 and the "a" surfaces of elements 1201 are presented towards second viewing direction 120. The obverse, "b," surfaces are presented towards third viewing direction 130 and fourth viewing direction 140.

FIG. 4C is the view of structure 100 along third viewing direction 130, which shows that, along this viewing direction, the following surfaces are in view: primary surfaces 1121*b*, 1123*b*, 1125*b*, 1127*b* and 1129*b* of plane 1120 and primary surfaces 1132*b*, 1134*b*, 1136*b*, and 1138*b* of plane 1130. Viewing direction 130 is also associated with secondary surfaces 1111*b*, 1113*b*, 1115*b*, 1117*b* and 1119*b*.

FIG. 4D is the view of structure 100 along fourth viewing direction 140, which shows that, along this viewing direction, the following surfaces are in view: primary surfaces 1222*b*, 1224*b*, 1226*b*, and 1228*b* of plane 1220 and primary surfaces 1231*b*, 1233*b*, 1235*b*, 1237*b*, and 1239*b* of plane 1230. Viewing direction 130 is also associated with secondary surfaces 1211*b*, 1213*b*, 1215*b*, 1217*b*, and 1219*b*.

As noted above, viewing structure 110 slightly off axis from viewing direction 130 or 140 will present corresponding secondary surfaces for viewing.

Figure 6:
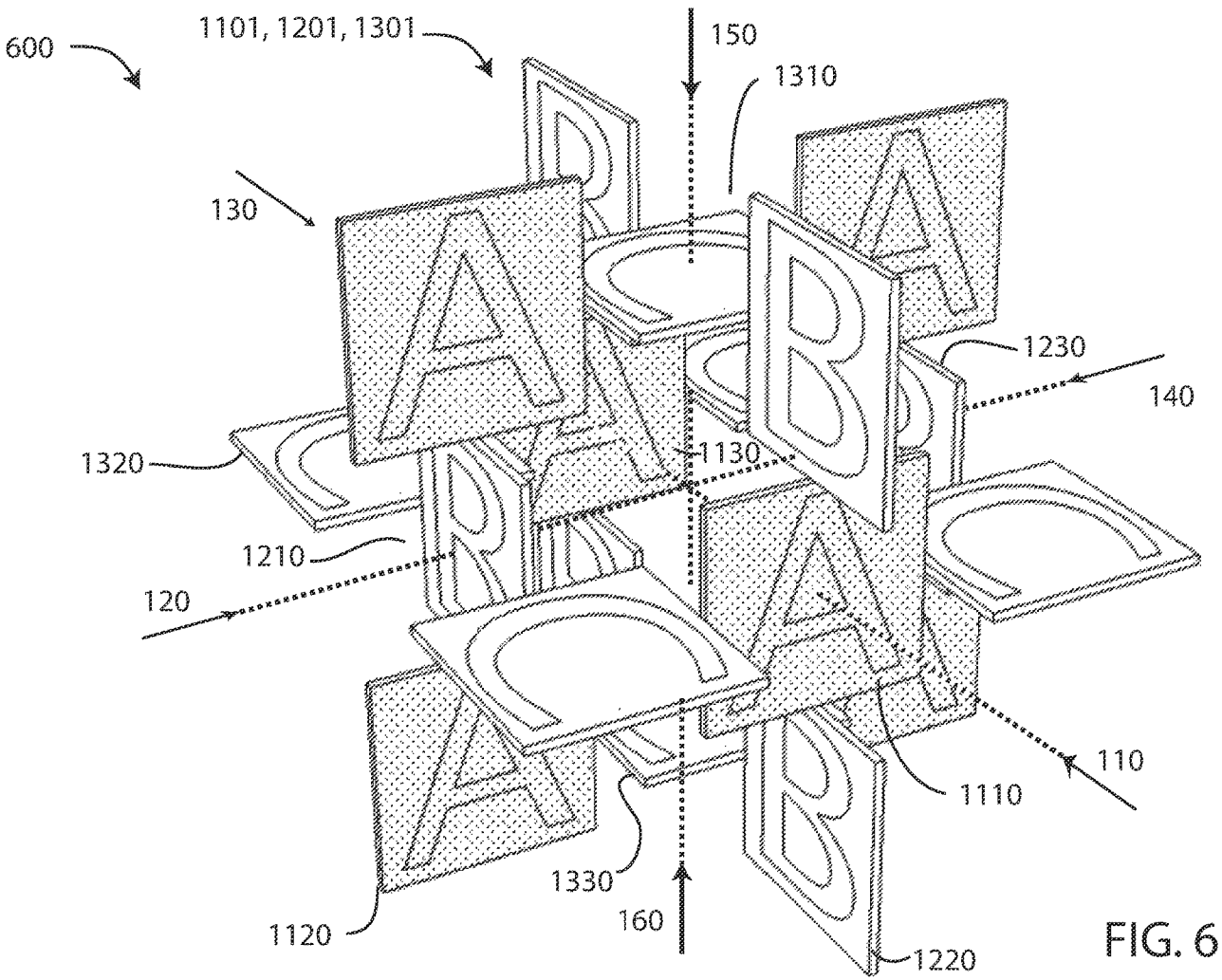
FIG. 6 is a perspective view of a structure having six viewing directions.

FIG. 6 is a perspective view of a structure 600 that is generally similar to structure 100, except as explicitly noted. Structure 600 differs primarily from structure 100 in that has up to six viewing directions. Thus, in addition to elements 1101 viewable along first viewing direction 110 and third viewing direction 130 and elements 1201 viewable along second viewing direction 120 and fourth viewing direction 140, structure 600 includes elements 1301 with primary surfaces that are viewable along fifth viewing direction 150 and secondary surfaces behind the primary surfaces, and opposing sixth viewing direction 160 which also includes primary and secondary surfaces. Thus, structure 600 has elements 1301 which are perpendicular to elements 1101 and 1201 are arranged in a first plane 1310, a second plane 1320, and a third plane 1330. The arrangement and visibility of elements 1301 is similar to that of elements 1101 and 1201, as described above, and the surfaces of elements 1301 include a first side facing fifth viewing direction 150 and opposite, second sides facing sixth viewing direction 160.

In certain embodiments, structures 100 and 600 may be provided an image that appears when viewed along one of the viewing directions, and may include images corresponding to each viewing direction. The images may be, for example, printed on or otherwise provided onto the surface of an element. In certain embodiments, the element supporting image is opaque. In certain embodiments the element supporting the image is opaque. In other embodiments, the element supporting the image is transparent.

Thus, for example, FIGS. 5A, 5B, 5C, and 5D show images 10, 20, 30, and 40, respectively. Each image is subdivided according to the shape and configurations of surfaces visible along one of the viewing directions. For structure 100, the view along each of the four viewing direction presents a 3×3 array of square surfaces, as indicated by FIGS. 4A-4D. Images 10, 20, 30, and 40 are likewise subdivided into like-shaped and arranged portions. Thus, the images 10, 20, 30, and 40 are shown in FIGS. 5A-5D as divided into an array of 9 portions (such as 10(1,1), 10(1,2), 10(1,3), . . . , 10(3,3).

For each image to appear along a corresponding viewing direction, the portions for each image, as shown in one of FIGS. 5A-5D, is matched with the a primary surface of FIGS. 4A-4D. Thus, for example, to have image 10 appear when structure 100 is viewed along a first viewing direction 110, the following image portions are applied to the following surfaces: portion 10(1,1) on primary surface 1121*a*; portion 10(1,2) on primary surface 1112*a*; portion 10(1,3) on primary surface 1123*a*; portion 10(2,1) on primary surface 1114*a*; portion 10(2,2) on primary surface 1125*a*; portion 10(2,3) on primary surface 1116*a*; portion 10(3,1) on primary surface 1127*a*; portion 10(3,2) on primary surface 1118*a*; and portion 10(3,3) on primary surface 1129*a*. For structure 600, a similar arrangement of images may be provided to any one or more of the 6 viewing directions of that structure.

Additional images of structure 600 are not shown, but follow the same general structure as the images of FIG. 5.

As structure 100 or 600, or the viewer, moves between viewing directions, from viewing direction 110 to viewing direction 120, for example, first the viewer sees image 10 from the markings on elements in planes 1210 and 1220. For slight angular rotations, the previously hidden elements in plane 1230 appear. Portions of elements in other planes eventually come into view, and when structure 100 is aligned with viewing direction 120, the viewers sees image 20.

It is not necessary to have images from only one static pose of a subject in an assembly. Images can be combined from different poses, and even different subjects in the same assembly, to create forms that morph and shape-shift, as the viewer moves around them. Since there are multiple view axes, each with a front and back side, imagery from multiple subjects may be merged into the same matrix to create intriguing kinetic displays. For instance, an advertising display for a brewery could take the form of a bottle with the imagery from that bottle on one axes, and imagery from a waterfall on the other axis. Since there is more than one subject being depicted in these assemblies, the external form will not match each subject and can be a neutral geometric form or a specific form that compliments the aggregate. The bottle described above does not match the form of the waterfall, but it does compliment it when used in the context of an advertisement. The sheets of pieces with the image of the waterfall would be combined with the sheets of images of the bottle and both cut to where they intersect the skin (profile) of the bottle, so a convincing 3 dimensional form is created.

In another embodiment, one view of an object is obtained and the view and its mirror image are provided to the structure when a rear view of the object is not available. An assembly may be made out of a single image by projecting that image onto two axes and staggering the image pieces between layers so that a coherent image is perceived at a diagonal between the two axes.

Imagery can be taken, for example and without limitation, from either cross-sections cut through the subject at intervals coordinated with the grid spacing, or by front and rear exterior views taken along the center of each of the axes. If exterior views are used, they may all be taken from equal distances from the subject, and from a distance sufficient to flatten the effects of foreshortening and perspective, so they align with each other to produce a more realistic form. If the images include sectional imagery taken along a plurality of planes perpendicular to an axis, then a different image will be placed onto each layer according to its appropriate geographic location within the matrix. Sectional imagery will be taken from the subject at the same geographic points as the layers within the matrix, so that when placed they create a coherent three-dimensional form within the structure of the matrix. The imagery can either be printed, or hand painted and illustrated onto the matrix structure. The portions of the matrix that are left outside of the bounds of the subject can either be removed, or left blank.

In certain embodiments, each image is reproduced onto a rigid sheet that may be cut into interlocking pieces and left nested together for the purposes of image reproduction. The interlocking pieces of the matrix are designed so that when detached from the nested sheet and assembled in the matrix, the image will be preserved through their aggregate. The external profiles plotted where each sheet intersects the skin of the form being reproduced may also cut. Each sheet has a different profile relative to its position along the view axis. The sheets are then printed on the front and back with corresponding front and back imagery from their axis. Each layer in the matrix will be porous because it will be made out of a series of interlocking pieces with space in between. Only the portions of each image that align with the faces of the interlocking pieces will be used in the display. The porosity of the displays allows both the interior and exterior of the three-dimensional form to be visible simultaneously.

Alternatively, the images may include, but are not limited to, solid color fields, abstract patterns, scenic views, or portraits.

Figure 7A:
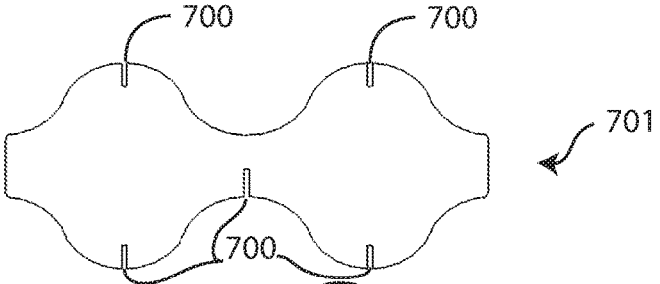
FIG. 7A shows an illustrative wave-shaped puzzle piece.
Figure 7B:
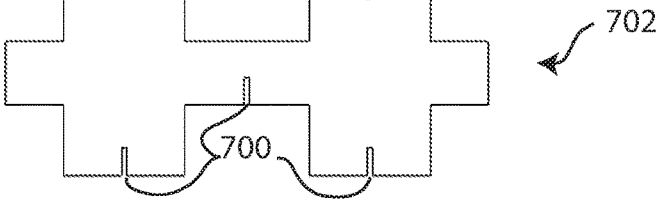
FIG. 7B shows an illustrative square-shaped puzzle piece.
Figure 7C:
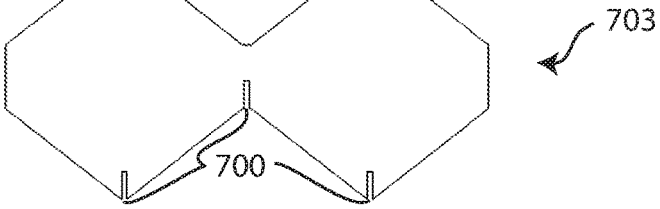
FIG. 7C shows an illustrative diamond-shaped puzzle piece.
Figure 7D:
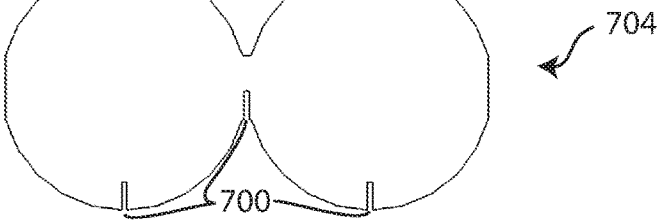
FIG. 7D shows an illustrative circle-shaped puzzle piece.
Figure 7E:
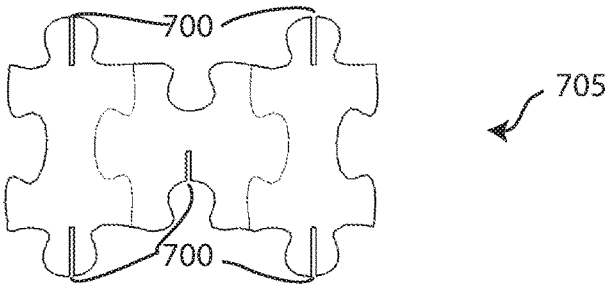
FIG. 7E shows an illustrative jigsaw-shaped puzzle piece.

In other embodiments, elements 1101 and 1201 puzzle pieces having any number of different shapes. FIG. 7A shows an illustrative wave-shaped puzzle piece 701, FIG. 7B shows an illustrative square-shaped puzzle piece 702, FIG. 7C shows an illustrative diamond-shaped puzzle piece 703, FIG. 7D shows an illustrative circle-shaped puzzle piece 704, and FIG. 7E shows an illustrative jig saw shaped puzzle piece 705. Each element has notches 700 to allow the elements it to accept another element at 90 degrees.

Figure 8:
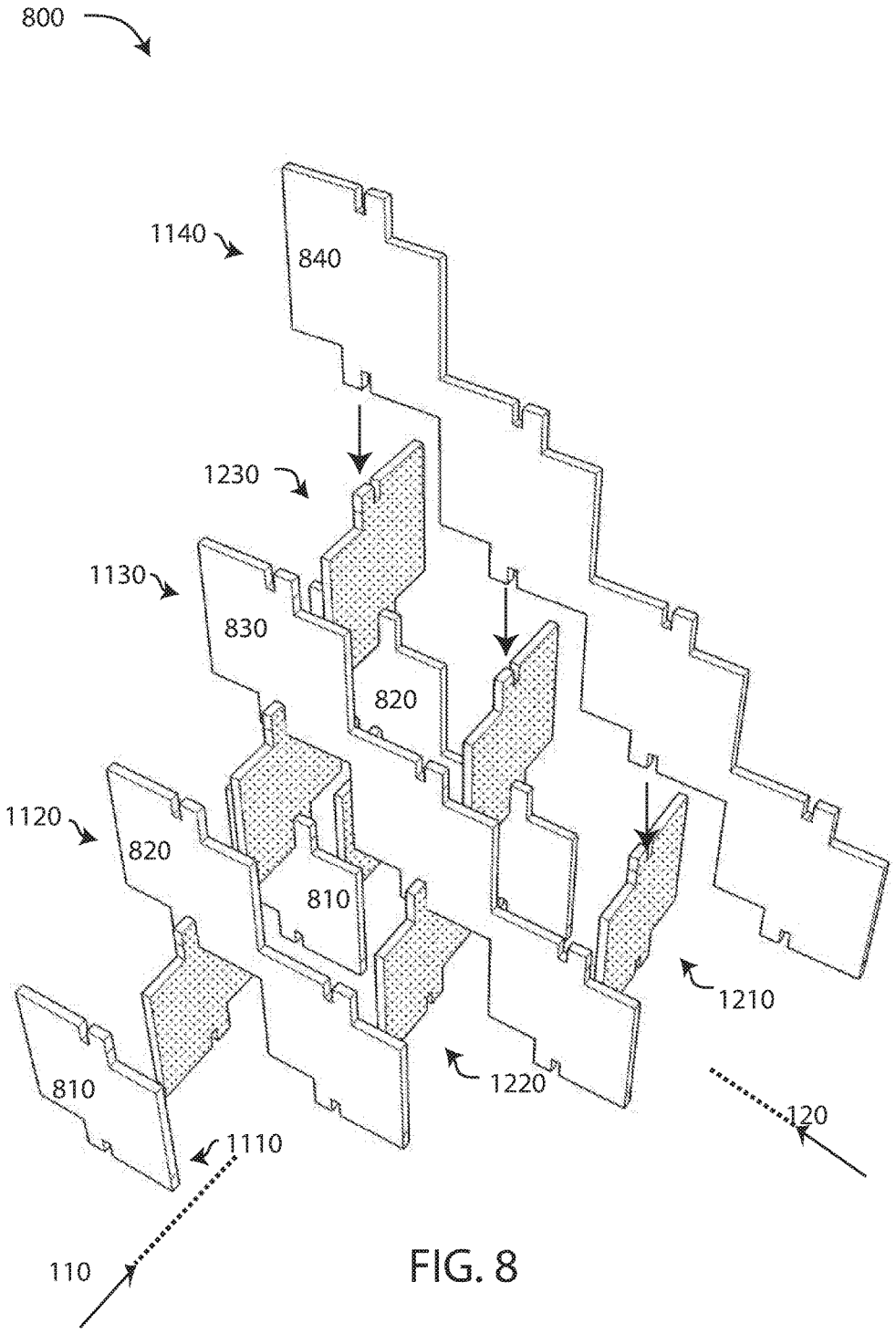
FIG. 8 shows how a puzzle is assembled with four planes of elements facing first viewing direction, and three planes of elements facing second viewing direction.

In other embodiments, elongated pieces may be of differing shapes. FIG. 8 shows how a puzzle 800 is assembled with four planes 1110/1120/1130/1140 of elements facing first viewing direction 110. and three planes 1210/1220/1230 facing second viewing direction 120. Plane 1110 includes only an element 810 which can include an image and be used as a primary surface, and which is also used in plane 1130 and which can include the same image as element 810 in plane 1110 to present a secondary surface. Plane 1120 includes only an element 820 which can include an image and be used as a primary surface, and which is also used in plane 1140 and which can include the same image as element 820 in plane 1120 to present a secondary surface. Plane 1130 also includes an element 1130, which can include a primary surface, and plane 1140 also includes an element 1140, which can include a primary surface.

Figure 9:
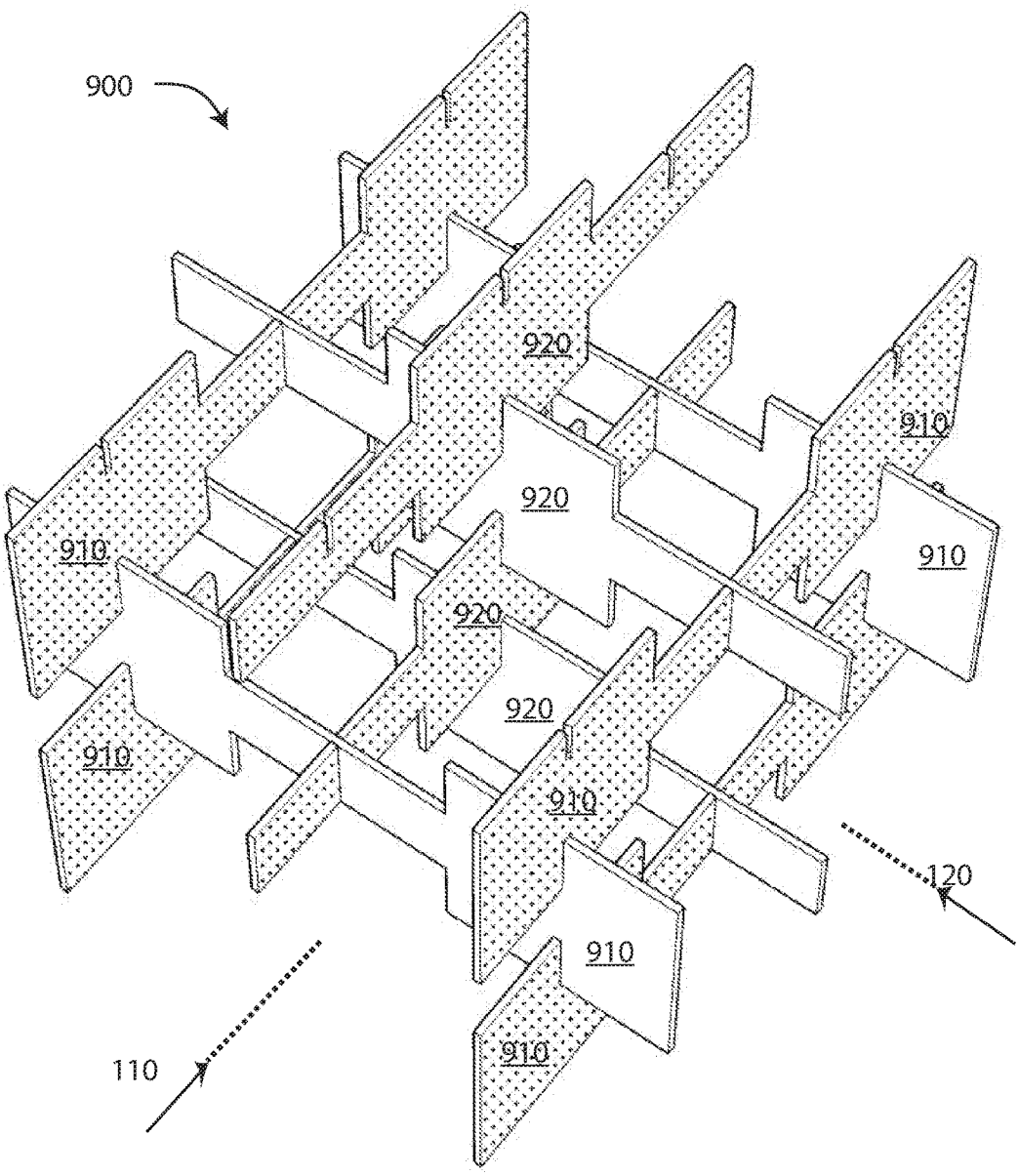
FIG. 9 shows how an alternative puzzle may be assembled with two differently shaped pieces.

FIG. 9 shows how an alternative puzzle 900 may be assembled with two differently shaped pieces 910 and 920.

Figure 10A:
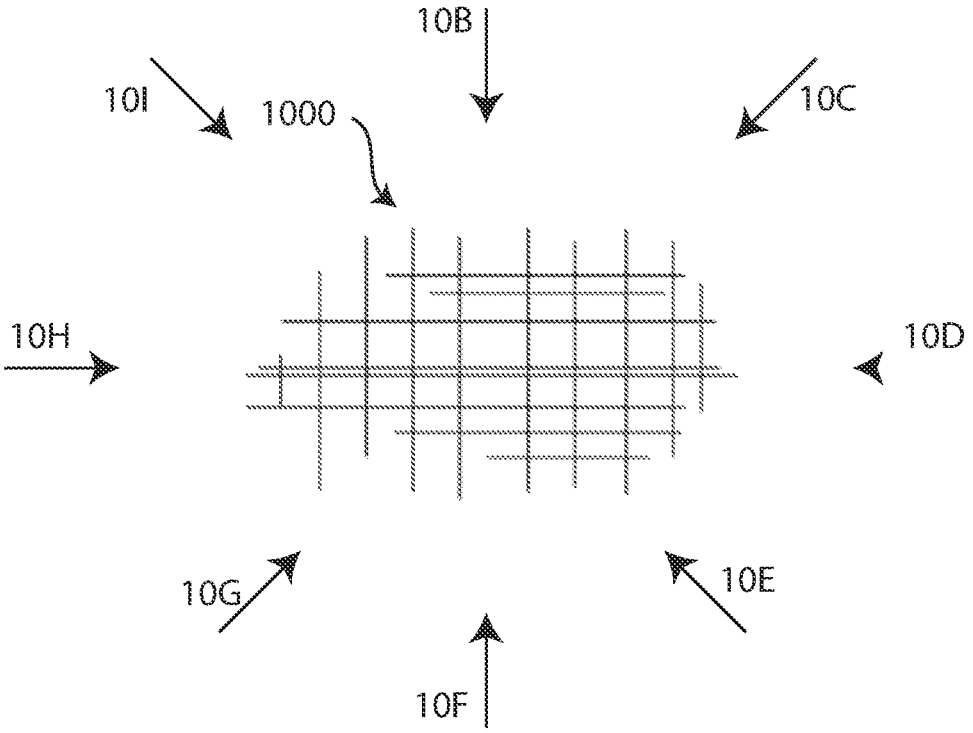
FIGS. 10A-10I illustrate a structure having four images viewable from four viewing direction, where
Figure 10B:
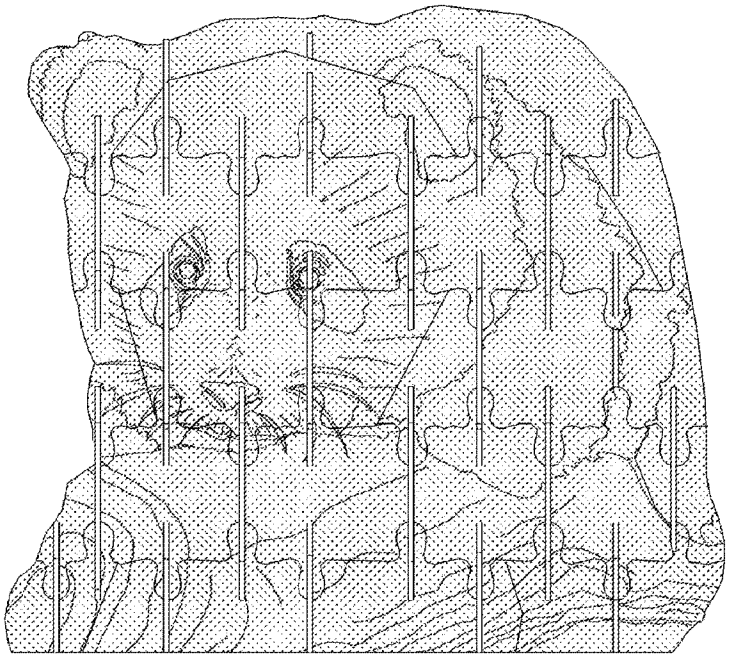
Figure 10C:
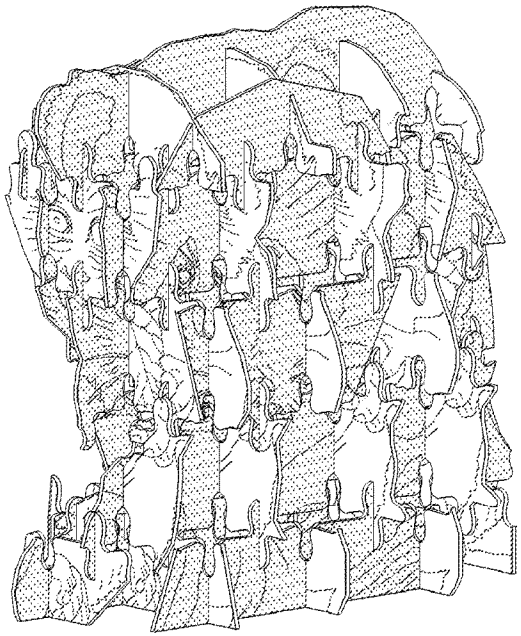
Figure 10E:
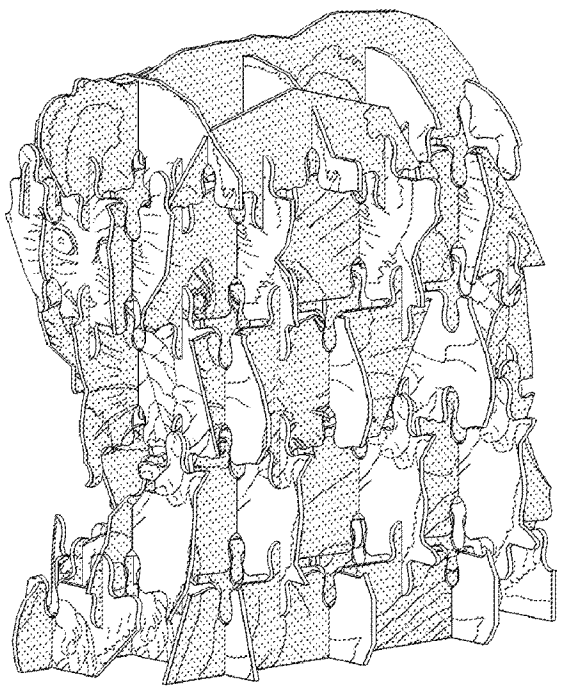
Figure 10D:
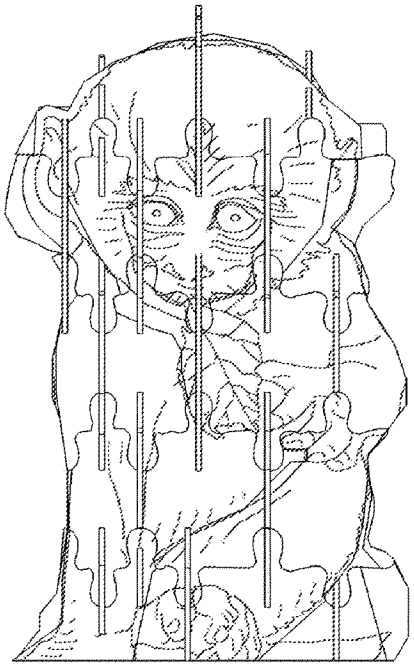
Figure 10G:
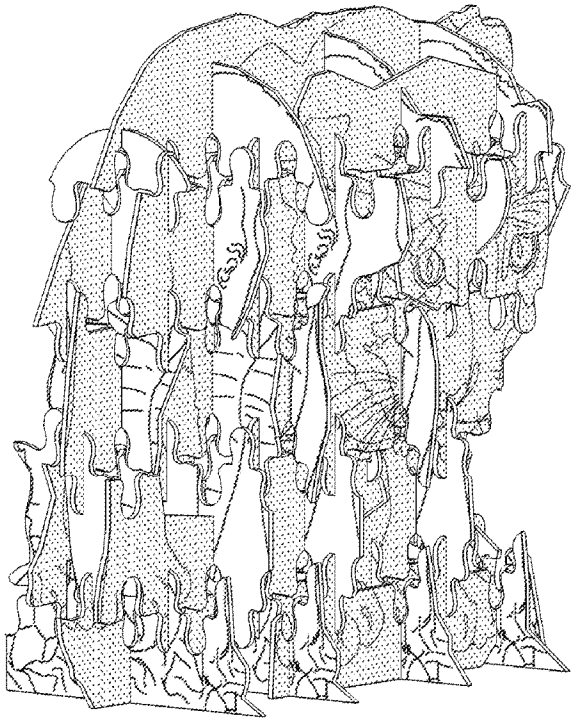
Figure 10F:
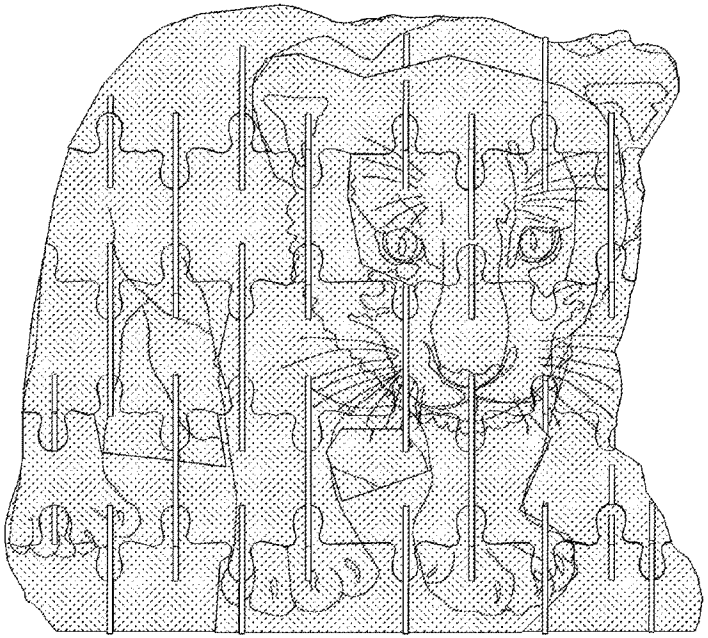
Figure 10I:
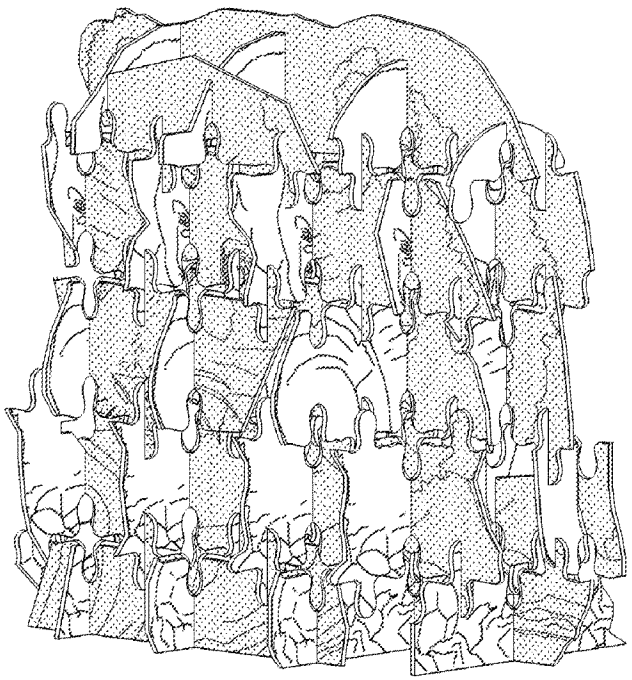
Figure 10H:
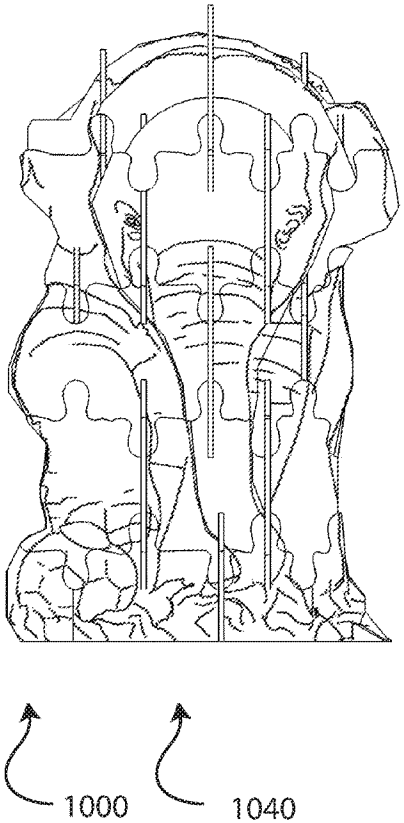

FIGS. 10A-10I illustrate a structure 1000 having four images viewable from four viewing direction, where FIG. 10A is a top view of the structure, FIG. 10B is a view of a first image 1010 as the structure is viewed along a first viewing direction 10B, FIG. 10C is a view of the stricture along a direction 10C halfway between the first viewing direction and a second viewing direction 10D, FIG. 10D is a view of a second image 1020 as the structure is viewed along the second viewing direction, FIG. 10E is a view of the structure along a direction 10E halfway between the second viewing direction and a third viewing direction 10F, FIG. 10F is a view of the third image 1030 as the stricture is viewed along the third viewing direction, FIG. 10G is a view of the stricture along a direction 10G halfway between the third viewing direction and a fourth viewing direction 10H, FIG. 10H is a view of a fourth image 1040 as the structure is viewed along the fourth viewing direction, and FIG. 10I is a view of the stricture along a direction 10I halfway between the fourth viewing direction and the first viewing direction.

Structure 1000 may be a puzzle, and is generally similar to the other structures and puzzles described herein, except as explicitly noted. FIGS. 10B-10I illustrate how structure presents images when viewed along viewing directions, and presents mixtures of adjacent images when viewed between viewing directions.

Figure 11A:
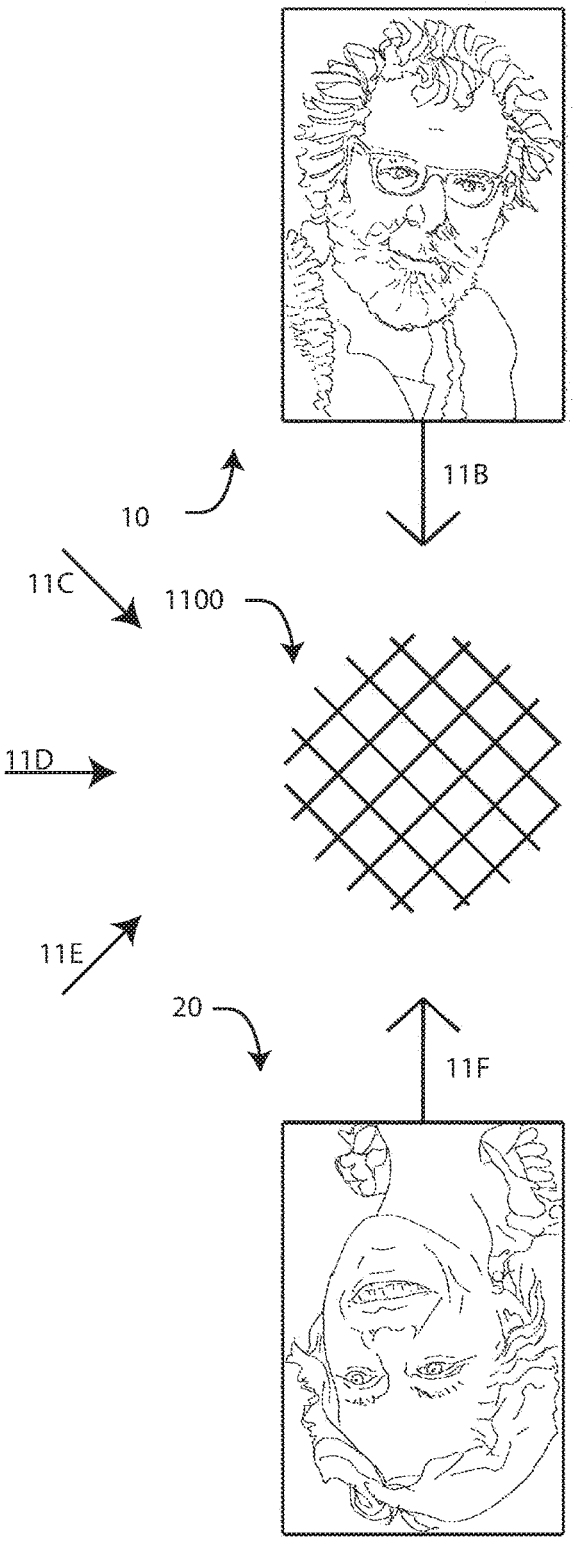
FIG. 11A illustrates a top view of structure having a first image viewable along a first viewing direction and second image viewable from an opposing, second viewing direction.
Figure 11B:
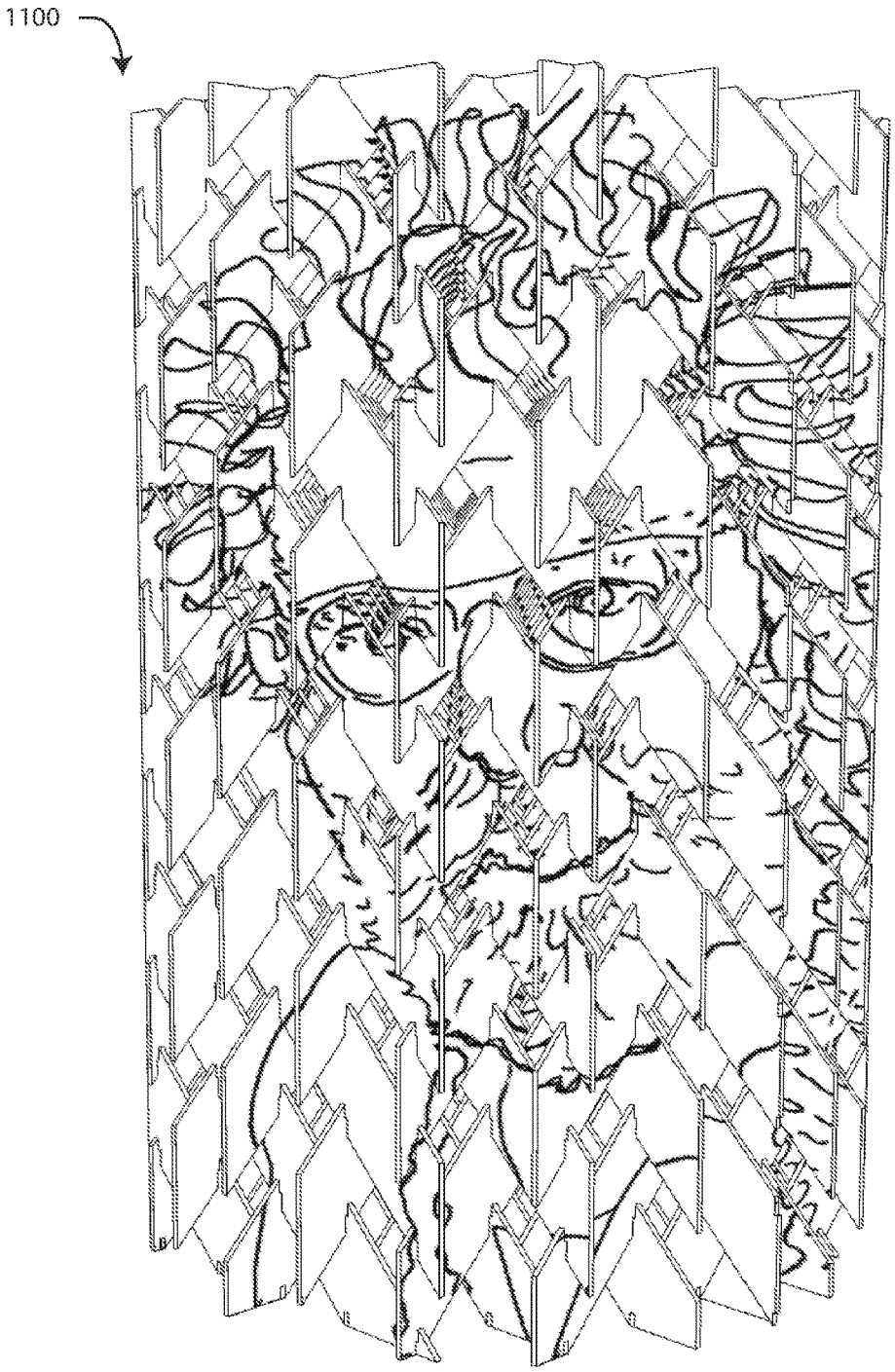
FIGS. 11B, 11C, 11D, 11E, and 11F are views of the structure of FIG. 11A along different directions.
Figure 11C:
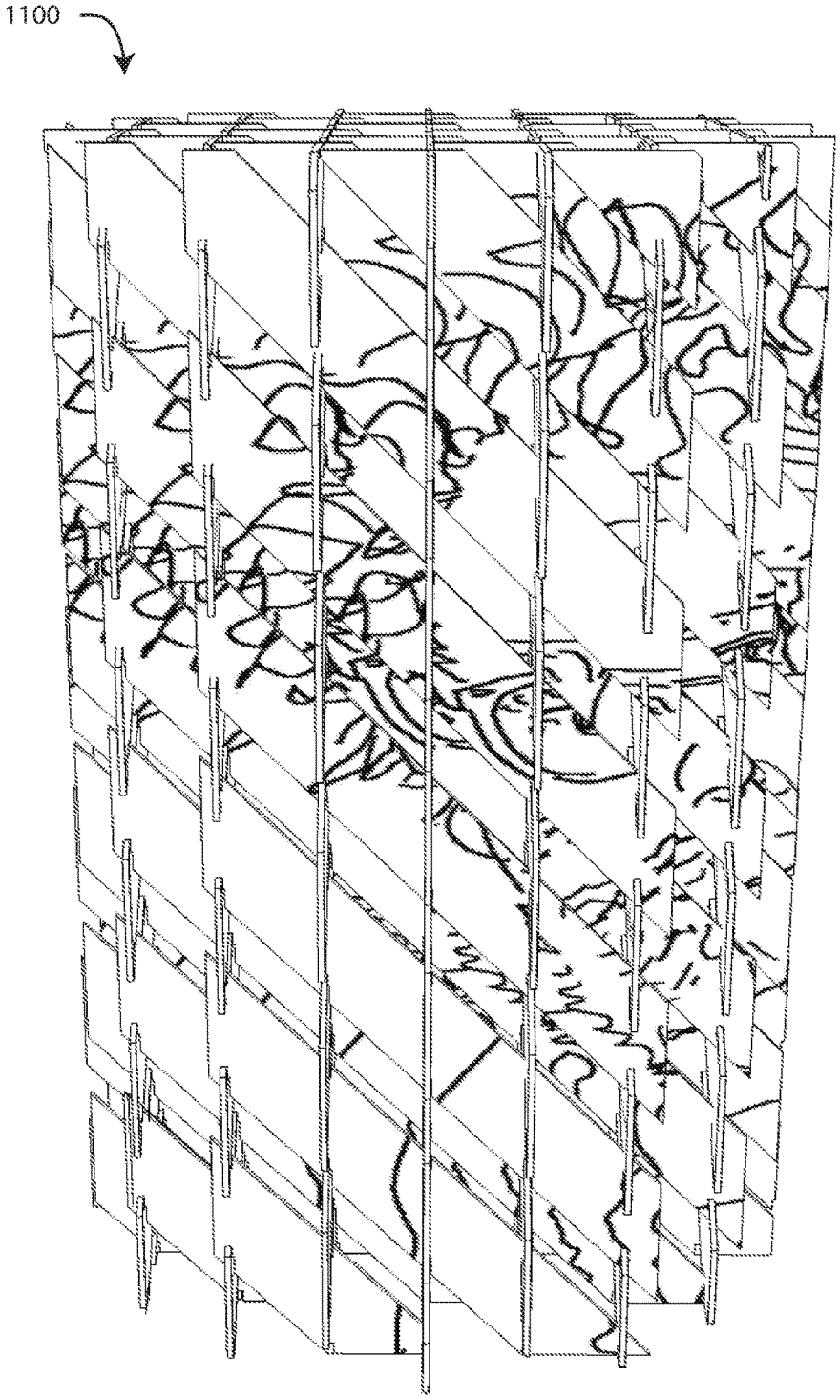
Figure 11D:
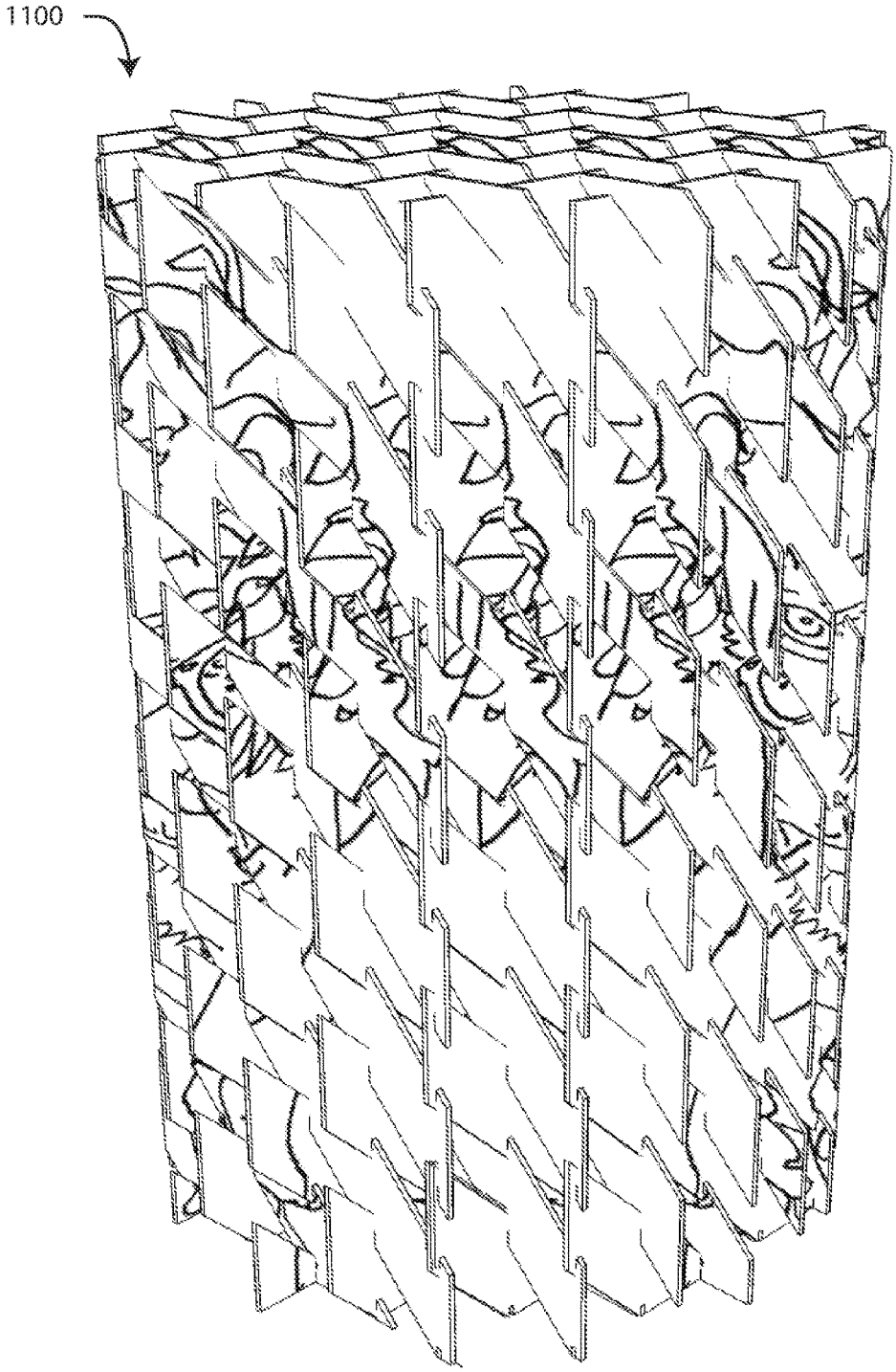
Figure 11E:
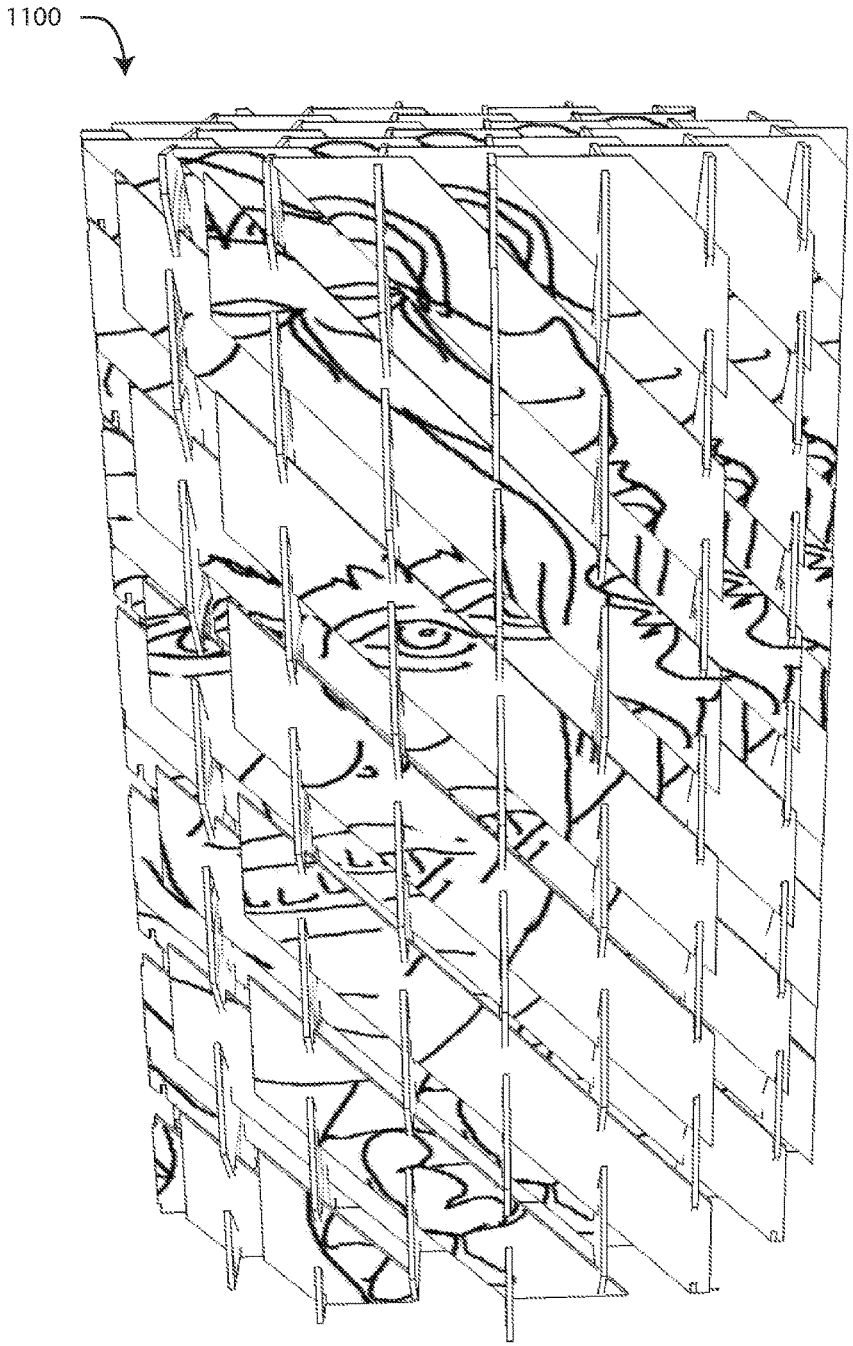
Figure 11F:
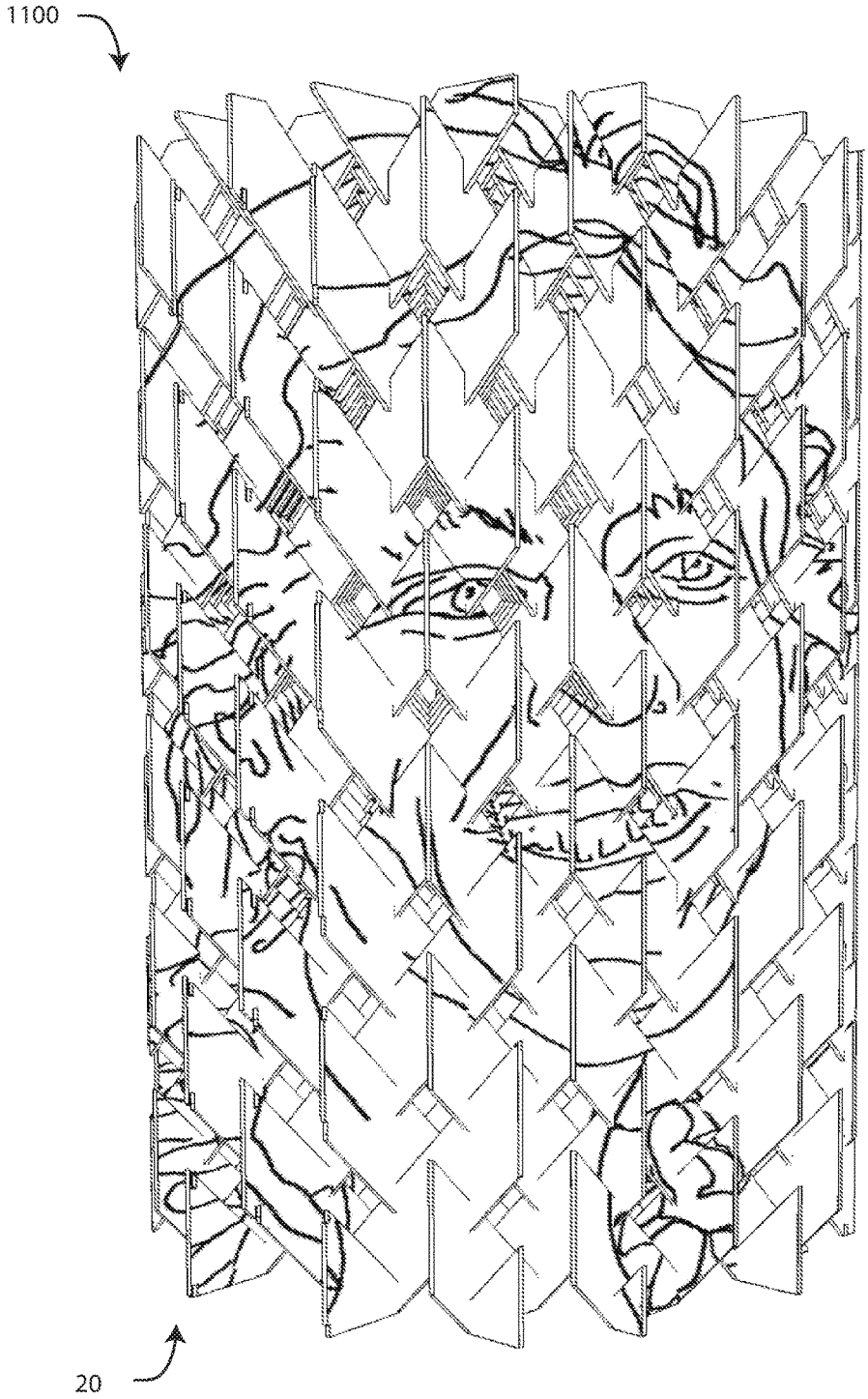

FIG. 11A illustrates a top view of structure 1100 having a first image 10 viewable along a first viewing direction 10A and second image 20 viewable from an opposing, second viewing direction 10F. The surfaces of structure 1100 are at 45 degrees to the viewing directions. Thus, in contrast to the previous embodiments in which each image is presented on surfaces normal to the viewing direction, the portions of each image of structure 1100 are disposed on surfaces that meet at 90 degrees. Structure 1100 may be a puzzle, and is generally similar to the other structures and puzzles described herein, except as explicitly noted.

The effect of viewing structure 1100 along directions 11B, 11C, 11D, 11E, and 11F, separated by 45 degrees, as labeled in FIG. 10A, is shown in FIGS. 10A-10F, respectively. The effect is similar to that of structure 1000, but since each image is on surfaces meeting at 90 degrees, the resulting change between viewing directions is more gradual, changing over 180 degrees.

In another embodiment, a structure or puzzle may have, in one or more viewing directions, one plane of primary surfaces and one plane of secondary surfaces. Thus, for example, an alternative embodiment of the structure of FIG. 1A may have plurality of elements 1101 in plane 1110 (being primary surfaces, for example) and in plane 1130 (being secondary surfaces, for example) with no elements in plane 1120, and plurality of elements 1201 in plane 1210 (being primary surfaces, for example) and plane 1230 (being secondary surfaces, for example), with no elements in plane 1220.

In other embodiments a structure, which may be but is not limited to a structure shown or described herein, is provided for display on an electronic device. Thus, for example and without limitation, a mathematical model of a structure is formed, where the model includes but is not limited to, the geometric configurations of the plurality of pieces forming the structure, and/or properties of such pieces or the surfaces of such pieces. The properties may include, but are not limited to, the opacity of one or more pieces or parts of pieces and/or images on surfaces or parts of surfaces of such pieces. According to programming in the electronic devices, the mathematical model is used to generate an image or a pair of stereo images on a display, such as the display of a computer monitor or the pair displays or display portions of virtual reality goggles. The generation of such a display from a numerical model of a structure according to a view angle, as described herein, would be obvious to one skilled in the art. The figures shown herein are thus examples of screen shots, or indicate the views of screenshots, on the display of an electronic device, including but not limited to, any one or FIG. 1A, 1B, 6, 9, 10B, 10C, 10D, 10E, 10F, 11B, 11C, 11D, 11E, or 11F.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A three-dimensional structure comprising:

a plurality of first pieces each having a corresponding surface of a plurality of first surfaces, where said plurality of first surfaces are adapted for viewing a first image along a first viewing direction of the three-dimensional structure, and where said plurality of first surfaces includes one or more primary surfaces each including a portion of said first image, where said portion of said first image on each of said one or more primary surfaces is visible when said three-dimensional structure is viewed along said first viewing direction, and one or more secondary surfaces each disposed behind an opaque portion of said one or more primary surfaces of said plurality of first surfaces when said three-dimensional structure is viewed along said first viewing direction, where each of said one or more secondary surfaces includes a portion of said first image; and a plurality of second pieces each having a corresponding surface of a plurality of second surfaces, where said plurality of second surfaces are adapted for viewing a second image along a second viewing direction of the three-dimensional structure, where said plurality of second surfaces includes one or more primary surfaces each including a portion of said second image, where said portion of said second image on each of said one or more primary surfaces is visible when said three-dimensional structure is viewed along said second viewing direction, and one or more secondary surfaces each disposed behind an opaque portion of said one or more primary surfaces of said plurality of second surfaces when said three-dimensional structure is viewed along said second viewing direction, where each of said one or more secondary surfaces includes a portion of said second image, such that portions of the first image on said one or more secondary surfaces of said plurality of first surfaces are visible when said three-dimensional structure is viewed off-axis from said first viewing direction, and such that portions of the second image on said one or more secondary surfaces of said plurality of first surfaces are visible when said three-dimensional structure is viewed off axis from said second viewing direction, where, for said plurality of first surfaces, said one or more primary surfaces is two or more primary surfaces, where one of said two or more primary surfaces is on one plane, and where a second of said two or more of primary surfaces is on a second plane that is different than said first plane.

2. The three-dimensional structure of claim 1, where, for said plurality of first surfaces, said portion of said image on each of said one or more secondary surfaces is said portion of said image that is on said one or more primary surfaces that are in front of said one or more secondary surfaces when said three-dimensional structure is viewed along said first viewing direction.

3. The three-dimensional structure of claim 1, where said plurality of first surfaces of said three-dimensional structure are normal to said first viewing direction, and where said plurality of second surfaces of said three-dimensional structure are normal to said second viewing direction.

4. The three-dimensional structure of claim 1, where said plurality of first surfaces of said three-dimensional structure are 45 degrees to said first viewing direction, and where said plurality of second surfaces of said three-dimensional structure are 45 degrees to said second viewing direction.

5. The three-dimensional structure of claim 1, where said first viewing direction and said second viewing direction are mutually perpendicular.

6. The three-dimensional structure of claim 1, where said first viewing direction and said second viewing direction are opposing views of said three-dimensional structure.

7. The three-dimensional structure of claim 1, where said plurality of first pieces each has an obverse surface, where each obverse surface of said first plurality of pieces includes a portion of a third image viewable along a third viewing direction of said three-dimensional structure which is opposing said first viewing direction of said three-dimensional structure.

8. The three-dimensional structure of claim 1, where said plurality of first pieces each has a first obverse surface of a plurality of first obverse surfaces, where said plurality of first obverse surfaces includes one or more primary surfaces each including a portion of a third image, where said portion of said third image on each of said one or more primary surfaces is visible when said three-dimensional structure is viewed along a third viewing direction; and one or more secondary surfaces each disposed behind an opaque portion of said one or more primary surfaces of said plurality of first obverse surfaces when said three-dimensional structure is viewed along said third viewing direction, where each of said one or more secondary surfaces includes a portion of said third image, such that portions of the third image on said one or more secondary surfaces are visible when said three-dimensional structure is viewed off-axis from said third viewing direction.

9. The three-dimensional structure of claim 1, where said plurality of second pieces each has a second obverse surface of a plurality of second obverse surfaces, where said plurality of second obverse surfaces includes:

one or more primary surfaces each including a portion of a fourth image, where said portion of said third image on each of said one or more primary surfaces is visible when said three-dimensional structure is viewed along a fourth viewing direction; and one or more secondary surfaces each disposed behind an opaque portion of said one or more primary surfaces said plurality of second obverse surfaces when said three-dimensional structure is viewed along said fourth viewing direction, where each of said one or more secondary surfaces includes a portion of fourth third image, such that portions of the fourth image on said one or more secondary surfaces are visible when said three-dimensional structure is viewed off-axis from said fourth viewing direction.

10. The three-dimensional structure of claim 1, where at least one piece of said plurality of first pieces has a slot for accepting one or more pieces of said plurality of second pieces, and where at least one piece of said plurality of second pieces has a slot for accepting one or more pieces of said plurality of first pieces.

11. The three-dimensional structure of claim 1, where a portion of at least one of said plurality of first pieces or a portion of at least one of said plurality of second pieces is opaque.

12. The three-dimensional structure of claim 1, where a portion of at least one of said plurality of first pieces or a portion of at least one of said plurality of second pieces is transparent.

13. A three-dimensional structure comprising:

a plurality of first pieces each having a corresponding surface of a plurality of first surfaces, where said plurality of first surfaces are adapted for viewing a first image along a first viewing direction of the three-dimensional structure, and where said plurality of first surfaces includes one or more primary surfaces each including a portion of said first image, where said portion of said first image on each of said one or more primary surfaces is visible when said three-dimensional structure is viewed along said first viewing direction, one or more secondary surfaces each disposed behind an opaque portion of said one or more primary surfaces of said plurality of first surfaces when said three-dimensional structure is viewed along said first viewing direction, where each of said one or more secondary surfaces includes a portion of said first image, and an obverse surface, where at least some of said obverse surfaces of said first plurality of pieces includes a portion of a third image viewable along a third viewing direction of said three-dimensional structure which is opposing said first viewing direction of said three-dimensional structure; and a plurality of second pieces each having a corresponding surface of a plurality of second surfaces, where said plurality of second surfaces are adapted for viewing a second image along a second viewing direction of the three-dimensional structure, where said plurality of second surfaces includes one or more primary surfaces each including a portion of said second image, where said portion of said second image on each of said one or more primary surfaces is visible when said three-dimensional structure is viewed along said second viewing direction, one or more secondary surfaces each disposed behind an opaque portion of said one or more primary surfaces of said plurality of first surfaces when said three-dimensional structure is viewed along said second viewing direction, where each of said one or more secondary surfaces includes a portion of said second image, and an obverse surface, where at least some of said obverse surfaces of said second plurality of pieces includes a portion of a fourth image viewable along a fourth viewing direction of said three-dimensional structure which is opposing said second viewing direction of said three-dimensional structure, such that portions of the first image on said one or more secondary surfaces of said plurality of first surfaces are visible when said three-dimensional structure is viewed off-axis from said first viewing direction, and such that portions of the second image on said one or more secondary surfaces of said plurality of first surfaces are visible when said three-dimensional structure is viewed off axis from said second viewing direction.

14. The three-dimensional structure of claim 13, where at least one piece of said plurality of first pieces has a slot for accepting one or more pieces of said plurality of second pieces, and where at least one piece of said plurality of second pieces has a slot for accepting one or more pieces of said plurality of first pieces.

15. A kit including including a plurality of pieces, such that a user may assemble said plurality of pieces to form said three-dimensional structure of claim 1.

16. The kit of claim 15, where at least one piece of said plurality of first pieces has a slot for accepting one or more pieces of said plurality of second pieces, and where at least one piece of said plurality of second pieces has a slot for accepting one or more pieces of said plurality of first pieces.

* * * * *